US008327792B2

(12) United States Patent
Ohman et al.

(10) Patent No.: US 8,327,792 B2
(45) Date of Patent: Dec. 11, 2012

(54) CANOE WITH MULTIPLE HULL SECTIONS

(75) Inventors: Richard Ohman, Maisoncelles du Maine (FR); Tomas Ohman, Mariefred (SE)

(73) Assignee: Point 65 Sweden AB, Solna (SE)

( * ) Notice: Subject to any disclaimer, the term of this patent is extended or adjusted under 35 U.S.C. 154(b) by 0 days.

(21) Appl. No.: 12/821,757

(22) Filed: Jun. 23, 2010

(65) Prior Publication Data

US 2010/0326345 A1 Dec. 30, 2010

(30) Foreign Application Priority Data

Jun. 24, 2009 (SE) ..... 0950486

(51) Int. Cl.
*B63B 35/71* (2006.01)

(52) U.S. Cl. ..... 114/347; 114/352

(58) Field of Classification Search ..... 114/352, 114/347, 77 A, 77 R
See application file for complete search history.

(56) References Cited

U.S. PATENT DOCUMENTS 3,150,385 A * 9/1964 Gerber et al. ..... 114/352
3,744,071 A * 7/1973 Bossler, Jr. ..... 114/352
3,822,427 A * 7/1974 Ewart, Jr. ..... 114/352
3,846,859 A * 11/1974 Vertrees ..... 114/352
3,883,909 A * 5/1975 Fisher et al. ..... 114/352
3,965,513 A * 6/1976 Horiuchi ..... 114/352

FOREIGN PATENT DOCUMENTS

GB 2432814 A 6/2007
WO 2007107997 A2 9/2007
WO 2008049158 A1 5/2008

* cited by examiner

*Primary Examiner* — Edwin Swinehart

(74) *Attorney, Agent, or Firm* — Jeffrey S. Melcher; Manelli Selter PLLC

(57) ABSTRACT

A canoe is provided, which is easier to store and transport than the canoes of the prior art, still being versatile, strong and durable in regard of its primary use as a paddling boat. The invention provides a collapsible canoe, such as a kayak, comprising at least two molded hull sections and also a method of manufacturing a canoe. The canoe comprises a joint for releasable connection of a first hull section to a second hull section, wherein each hull section of the joint comprises means for mating the other hull section. Thereby the invention provides a canoe having sections that can be connected for use as a boat and separated for transport and storing. Preferably, the mating means are molded into each respective hull section.

5 Claims, 9 Drawing Sheets

CANOE WITH MULTIPLE HULL SECTIONS

TECHNICAL FIELD

The present invention relates generally to canoes, such as a sit-top or sit-in kayak, and especially to a canoe comprising at least three sections. The present invention also relates to the manufacturing of such a canoe, and especially molding the hull sections.

BACKGROUND

Modern kayaks are often rotation molded in polyethylene. The rotation molding process is rational and economic, especially in comparison to the manufacture of fiberglass boats. The molding technology provides strong and durable kayaks. A variety of versatile kayaks adapted for a wide range of specific use are available, such as long distance paddling, paddling in the archipelago or at sea.

These kayaks are well adapted for their different purposes and show different character in regard of maneuverability, stability and speed but they all have the drawback that they are not specifically adapted for storing or transporting when they are not used.

SUMMARY OF INVENTION

It is an object of the present invention to provide a canoe that are easier to store and transport than canoes of prior art. The canoe according to the present invention is still being versatile, strong and durable in regard of its primary use as a paddling boat.

For this purpose the present invention provides a divisible canoe, such as a kayak, comprising at least two molded hull sections. The present invention further relates to a method of manufacturing such a canoe. The canoe comprises a joint for releasable connection of the first hull section to the second hull section, wherein each hull section of the joint comprises means for mating the adjacent hull section of the joint.

The present invention thereby provides a canoe having sections that can be connected for use as a boat and separated for transport and storing. Particular advantages compared to other solutions are the instant and effortless joining and separating of the parts where no tools, screws or other loose parts are needed and the strength of the canoe that in its self resists the forces involved through the weight of the paddler and gear and the forces of the elements, particularly the pressure created by waves. Other known solutions are dependent for their strength in the joining together of the parts by screws and other means, but the canoe according to the present invention is self supported and the buckles used are only to keep the parts from sliding apart and have no bearing on the strength.

In a preferred embodiment, the canoe comprises at least three hull sections and joints for releasable connection of each hull section to the adjacent hull section. Each hull section comprises means for mating the adjacent hull section of the joint. Thereby, the length of the canoe is optional by mounting only two of the sections together, providing a one-man canoe, or providing a two-man canoe by mounting all three sections together.

In another preferred embodiment are 3 the mating means molded into each of said respective hull section.

In yet another preferred embodiment comprises the mating means at least one protruding member and at least one corresponding groove, provided in respective one of said hull sections.

In yet another preferred embodiment comprises the mating means multiple protruding members and respective multiple corresponding grooves, provided in respective one of said hull sections.

In yet another preferred embodiment have the mating means a substantially longitudinal mating direction.

In yet another preferred embodiment is locking means comprised for locking said hull sections together when they are joined.

In yet another preferred embodiment includes the locking means a two-part clasp.

In yet another preferred embodiment is the locking means arranged to lock reciprocal movement of said hull sections in the mating direction.

The invention also provides a method for manufacturing such a canoe, including the step of molding the two hull sections and the mating means, wherein the mating means of each hull section is molded in the section. Molding the joints into the hull sections when molding the hull sections facilitates keeping the hull sections watertight and also keeps the manufacturing simple.

In a preferred embodiment, the method includes molding the mating means into bulkheads of said respective hull sections.

Preferably the sections are blow molded or rotation molded in a polymer, such as polyethylene, and the mating means are molded together with the sections.

The mating means are preferably molded into a respective bulkhead of its hull section. Preferably, the molding includes molding at least one part of locking means into at least one hull section. Preferably, the hull sections are blow molded or, more preferably, rotation molded of a polymer, preferably polyethylene.

BRIEF DESCRIPTION OF THE DRAWINGS

The invention will be described in greater detail below with reference to the accompanying drawings, wherein.

DETAILED DESCRIPTION

In the following, for purposes of explanation and in order to provide an understanding of the present invention, exemplifying embodiments are presented. However, it will be apparent to one skilled in the art that the present invention may be practiced in other embodiments that depart from the specific details of these examples. Moreover, description of those details of a canoe in accordance with the invention that are similar to corresponding details of an ordinary non-dividable canoe have been omitted.

Figure 1:
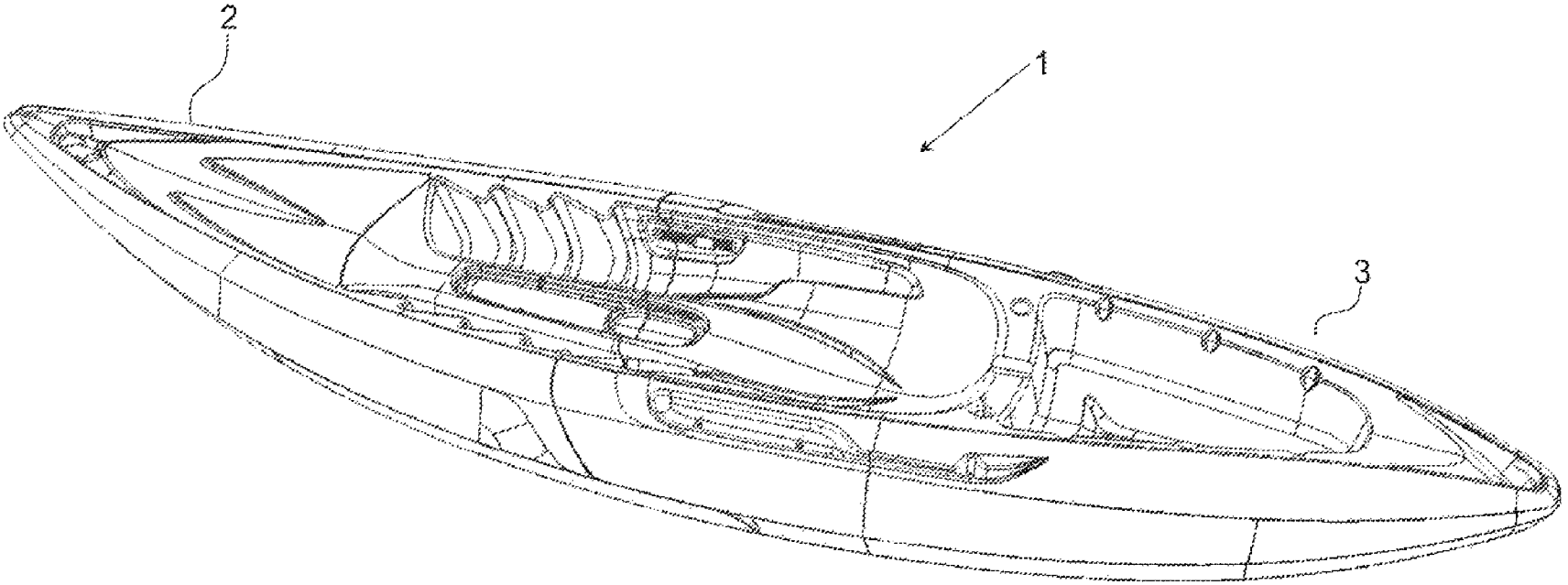
FIG. 1 illustrates a canoe having two hull sections when joined together.

FIG. 1 illustrates a canoe 1 comprising two hull sections 2, 3. The hull sections 2, 3 are floatable and make up a canoe when joined in the longitudinal direction, from stem to stern. The first hull section 2 can be connected to the second hull section 3 by means of a first joint comprising a plurality of cylindrical male projections for insertion into at least one female groove.

Figure 2:
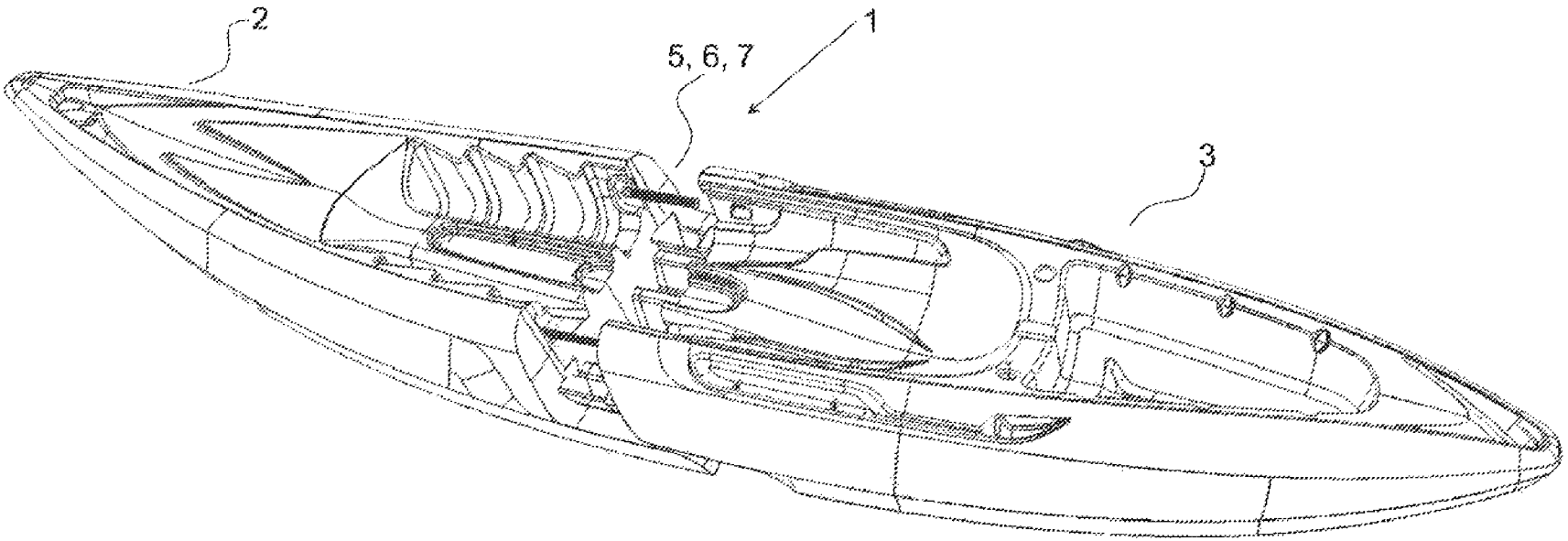
FIG. 2 illustrates a canoe having two hull sections when the hull sections are apart.

FIG. 2 show the same canoe 1 as shown in FIG. 1 with the two hull sections 2, 3 slightly apart. The hull sections 2, 3 are joined together by mating means comprising protruding members and corresponding grooves arranged in respective hull section 2, 3. The hull sections are joined together by a substantially longitudinal mating direction with self-strengthening and self-locking by protruding members and corresponding grooves arranged in respective hull section. The protruding member and the corresponding groove are sufficiently long to withstand substantial side forces and torsional forces. In one embodiment, the length of each protruding member and corresponding groove is at least one tenth of its respective hull section.

Figure 3:
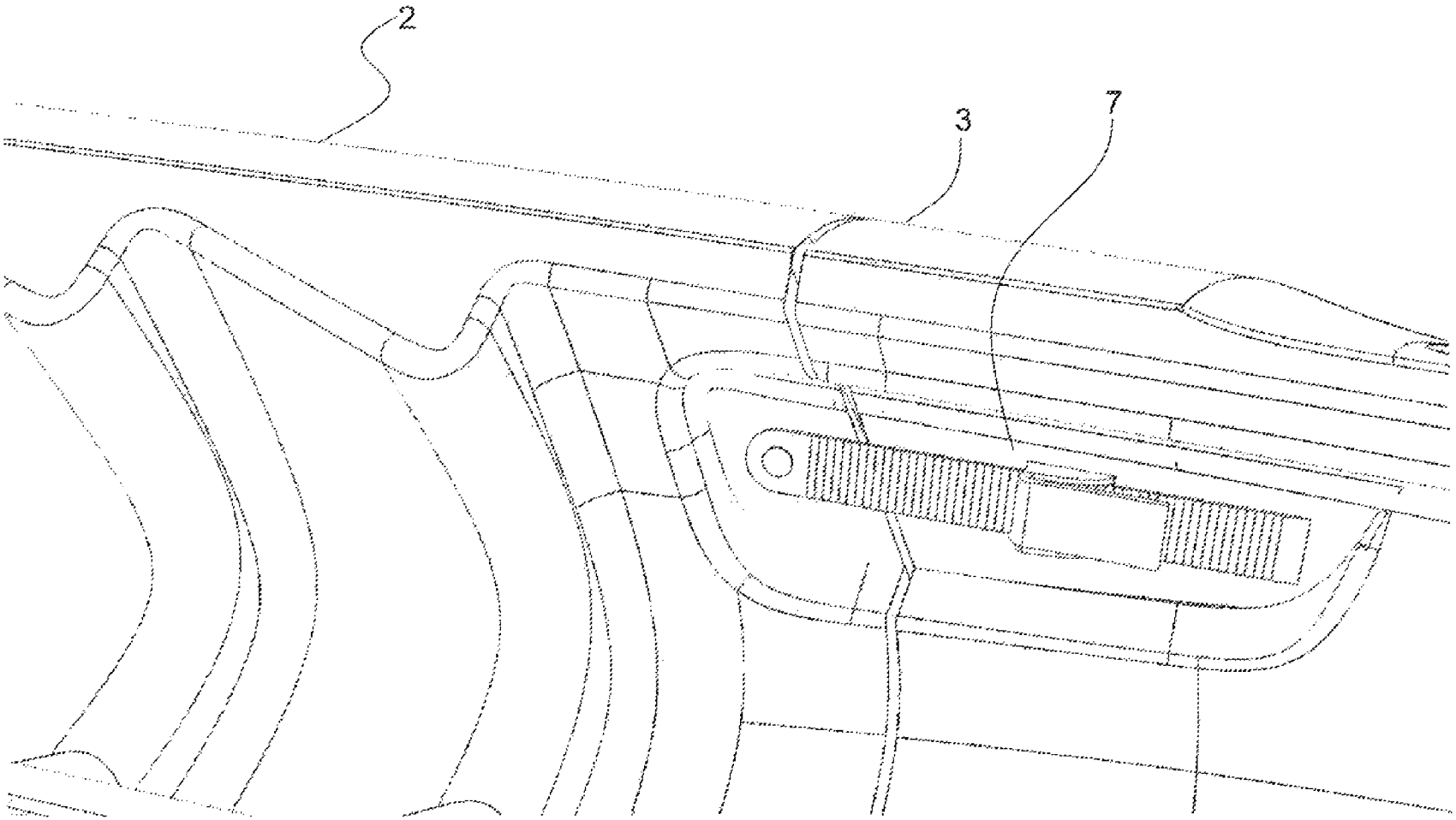
FIG. 3 illustrates locking means for securing the joint in place when locked.
Figure 4:
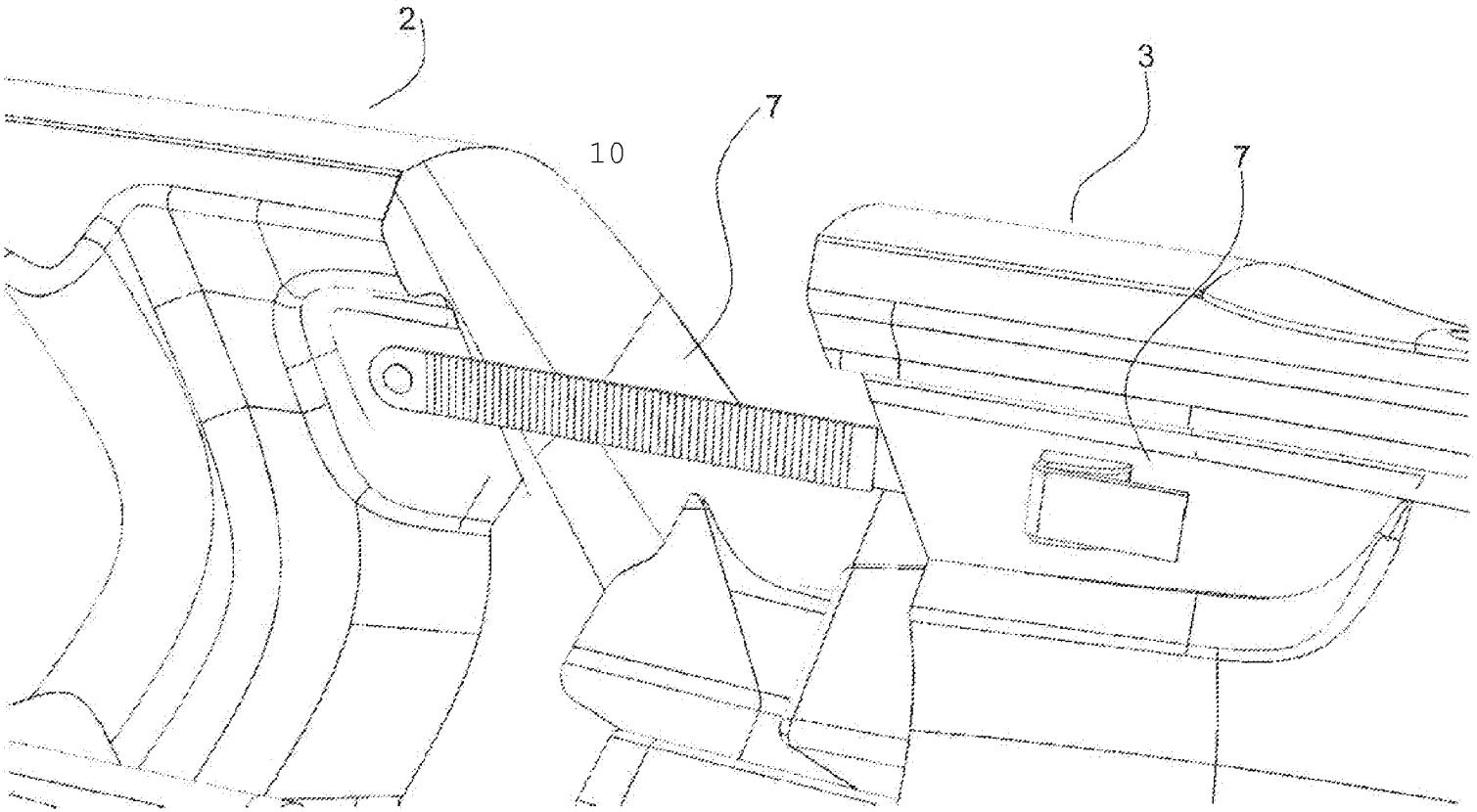
FIG. 4 illustrates the locking means in place when open.

FIG. 3 show a clasp used for locking the hull sections together. FIG. 3 show the clasp in its locked position when in use for locking two hull sections together. FIG. 4 show the clasp in place in its open position.

Figure 5:
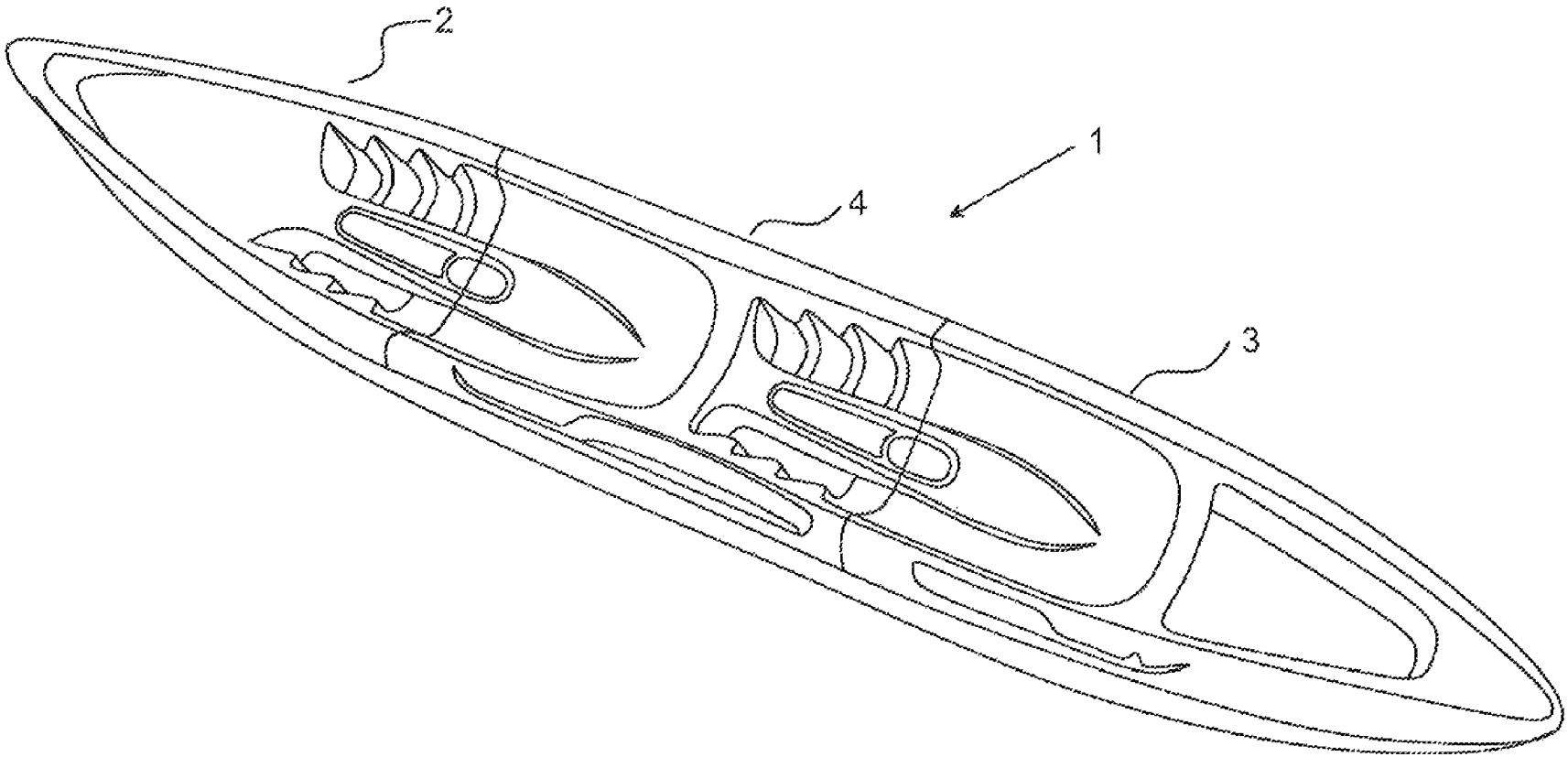
FIG. 5 illustrates a canoe having three hull sections when joined together.

FIG. 5 illustrates a canoe 1 comprising three hull sections 2, 3, 4.

Figure 6:
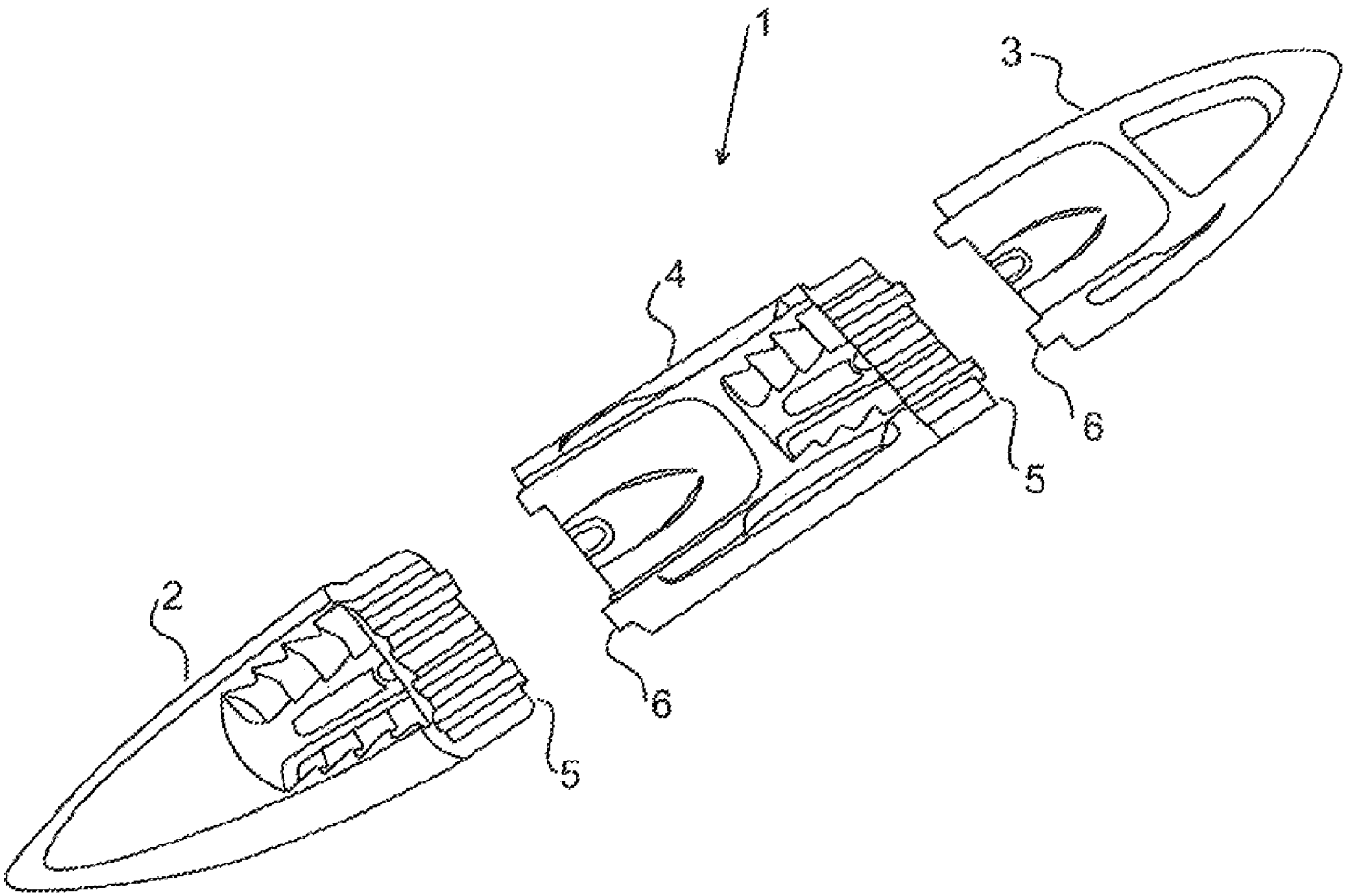
FIG. 6 illustrates a canoe having three hull sections when the hull sections are apart.

FIG. 6 show the same canoe 1 as shown in FIG. 6 with the three hull sections 2, 3, 4 slightly apart. The hull sections 2, 3, 4 are joined together by mating means comprising protruding members and corresponding grooves arranged in respective hull section 2, 3, 4.

Figure 7:
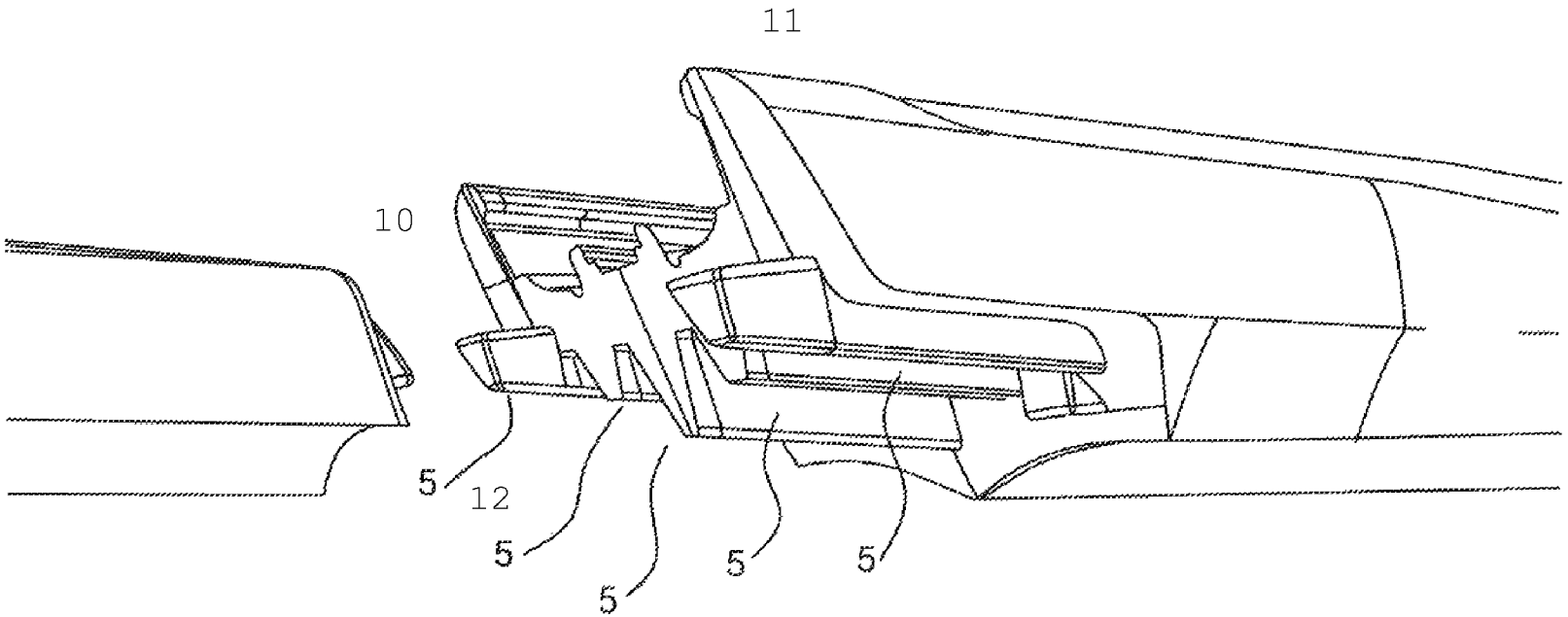
FIG. 7 illustrates mating means for joining two adjacent hull sections.
Figure 8:
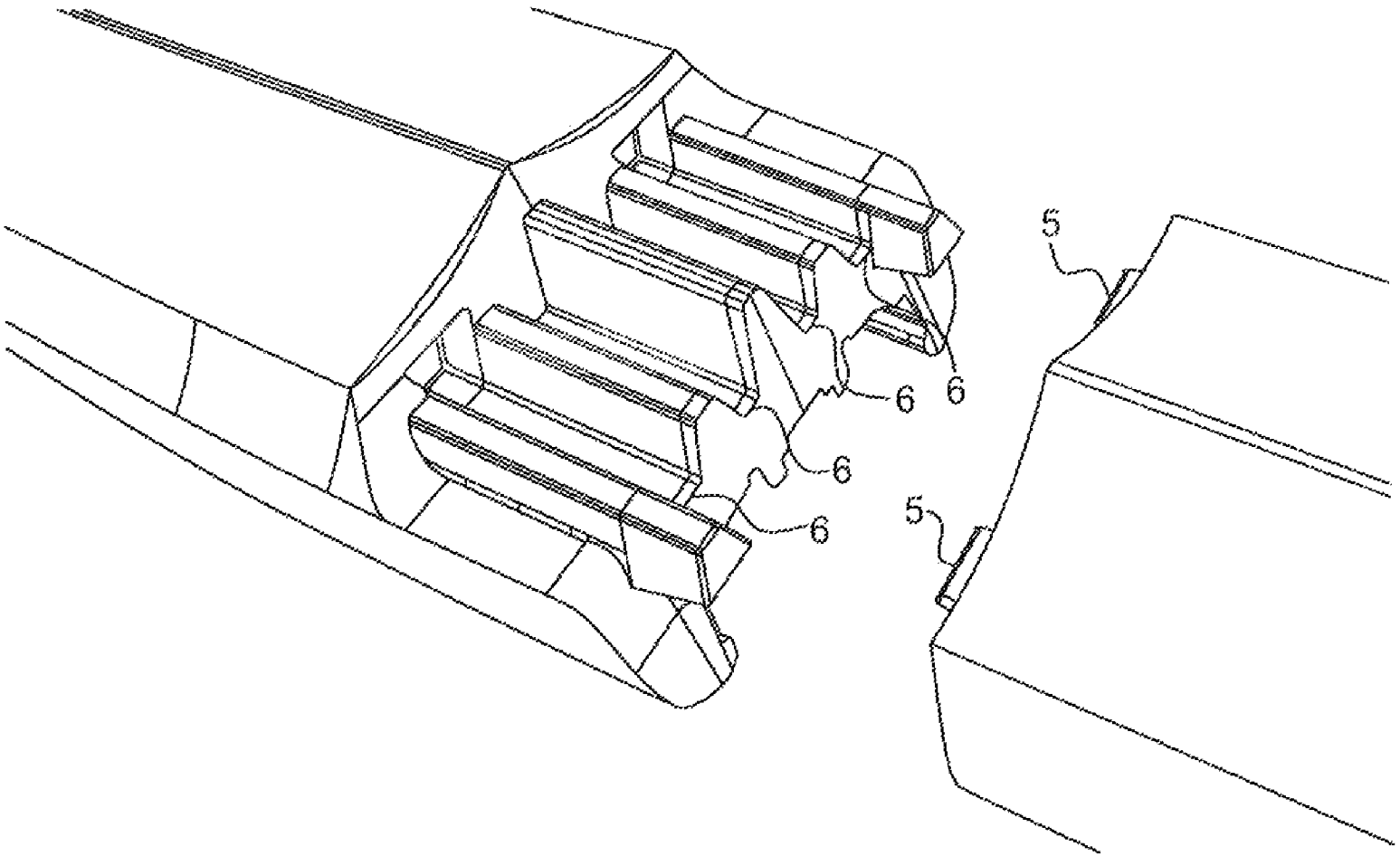
FIG. 8 illustrates mating means for joining two adjacent hull sections from a second perspective.
Figure 9:
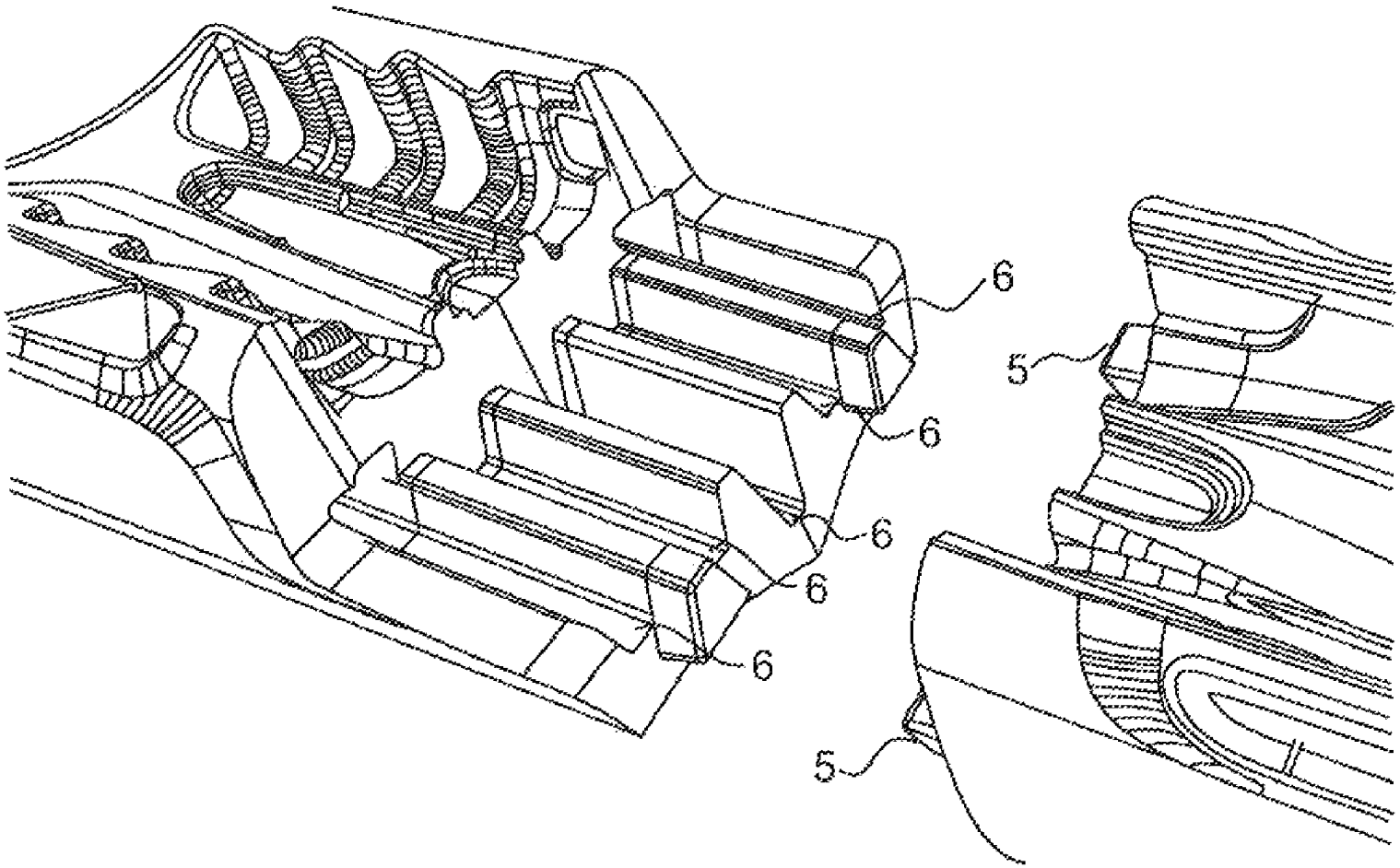
FIG. 9 illustrates mating means for joining two adjacent hull sections from a third perspective.

FIG. 7 show details of the mating means joining the hull sections 2, 3 together. FIGS. 8 and 9 also show details of the mating means joining the hull sections 2, 3 together. A plurality of protrusions 5 are arranged in the hull section 3, and corresponding female grooves 6 in the first hull section 2.

The hull sections are connected by mating the male protrusions 5 into the female grooves 6 by moving the sections together in the longitudinal direction of the assembled kayak. The female groove 6 have an inner wall surrounding the male protrusions 5 in two perpendicular directions, the vertical direction Z and the transversal direction Y, restraining relative movement of the hull sections 2, 3 in the vertical and the transversal directions. After joining of the hull sections by pushing them together in the longitudinal mating direction, the hull sections can be locked together by locking arrangement 7 arranged to interlock and secure the hull sections together precluding relative longitudinal movement of the sections. The locking arrangement is illustrated as a clasp 7. It is to be noted, however, that due to the length and joint strength achieved by the protrusions and grooves, the locking arrangement mainly has to with stand longitudinal movement and can be made using a relatively simple construction.

In each of the embodiments shown, one of the hull sections is provided with a seat arranged on top of a deck 12 of the section. Thus, the illustrated canoe is a so-called sit-on kayak, but a sit-in kayak having a seat arranged inside the hull section can alternatively be provided using similar joints between the hull sections. The hull section comprises the deck 12 and two opposing side walls 10, 11 extending from the deck 12.

The hull sections are connected by mating the male protrusions 5 into the respective female groove 6 by moving the sections together in the longitudinal direction of the assembled kayak. The female groove 6 have an inner wall surrounding the male protrusions 5 in two perpendicular directions, the vertical direction Z and the transversal direction Y, restraining relative movement of the hull sections 2, 3 in the vertical and the transversal directions. After joining of the hull sections by pushing them together in the longitudinal mating direction X, the hull sections can be locked together by locking arrangement 7 arranged to interlock and secure the hull sections together precluding relative longitudinal movement of the sections. The locking arrangement is illustrated as a clasp 7.

Although all embodiments of the canoe are preferably rotation molded in at least two connectable and separable hull sections having mating means molded into a respective bulkhead surface of each section, it will be appreciated that the construction can advantageously be utilized also when building canoes in fiberglass enforced plastic, like polystyrene.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. Method for manufacturing a canoe comprising:

molding a first hull section from a polymer, the first hull section having a first end of the canoe and a second end opposite the first end of the canoe, the second end having a plurality of male protrusions protruding in a longitudinal direction of the canoe, the first hull section being floatable, the first hull comprising a deck and two opposing side walls extending from the deck;

molding a second hull section from a polymer, the second hull section having a second end of the canoe and a third end opposite the second end of the canoe, the second hull comprising a deck and two opposing side walls extending from the deck, the third end having a plurality of female grooves constructed to mate with the male, the first hull section being connectable to the second hull section by moving the first and second hull sections towards one another in a longitudinal direction which slides the male protrusions into the female grooves so that the decks and side walls of the first hull section contact the deck and side walls of the second hull section, the longitudinal direction being aligned with a length of the canoe, the male protrusion sized so that they protrude into the female grooves at least one tenth of a length of the second hull section when inserted into the female grooves so that the canoe can withstand substantial side forces and torsional forces and relative movement between the hull sections is restrained when the hull sections are connected together; and providing a locking arrangement constructed so that when in the locked position the male protrusions cannot be slid out of the female grooves, the locking arrangement being disposed on both side walls of the first and second hulls, and the locking arrangement comprising a clasp that locks reciprocal movement of the first and second hull sections in the longitudinal direction.

2. The method according to claim 1, further comprising constructing the female grooves so that the male protrusions are surrounded in two perpendicular directions when the male protrusions are inserted within the female grooves .

3. The method according to claim 1, further comprising molding at least one center hull section having opposing fourth and fifth surfaces, the fourth surface having male protrusions of the same shape as the male protrusions on the second end of the first hull section and female grooves of the same shape as the female grooves on the third end of the second hull section, so that the center hull section is connectable between the first hull section and the second hull section.

4. Canoe comprising:

a first hull section having a first end of the canoe and a second end opposite the first end of the canoe, the second end having a plurality of male protrusions protruding in a longitudinal direction of the canoe, the first hull section comprising a molded polymer and being floatable, the first hull comprising a deck and two opposing side walls extending from the deck;

a second hull section having a second end of the canoe and a third end opposite the second end of the canoe, the second hull comprising a deck and two opposing side walls extending from the deck, the third end having a plurality of female grooves constructed to mate with the male protrusions, the first hull section being connectable to the second hull section by moving the first and second hull sections towards one another in the longitudinal direction which slides the male protrusions into the female grooves so that the decks and side walls of the first hull section contact the deck and side walls of the second hull section, the longitudinal direction being aligned with a length of the canoe, the male protrusion sized so that they protrude into the female grooves at least one tenth of a length of the second hull section when inserted into the female grooves the canoe can withstand substantial side forces and torsional forces and relative movement between the connected hull sections is restrained when the hull sections are connected together; and locking arrangement constructed so that when in the locked position the male protrusions cannot be slid out of the female grooves, the locking arrangement being disposed on both side walls of the first and second hulls, and the locking arrangement comprising a clasp that locks reciprocal movement of the first and second hull sections in the longitudinal direction.

5. The canoe according to claim 4, further comprising a center hull section having opposing fourth and fifth surfaces, the fourth surface having male protrusions of the same shape as the male protrusions on the second end of the first hull section and female grooves of the same shape as the female grooves on the third end of the second hull section, so that the center hull section is connectable between the first hull section and the second hull section.

* * * * *